US007971654B2

(12) United States Patent
Takeyama et al.

(10) Patent No.: US 7,971,654 B2
(45) Date of Patent: Jul. 5, 2011

(54) ROTARY IMPACT TOOL

(75) Inventors: Atsushi Takeyama, Yasu (JP); Hidenori Shimizu, Hikone (JP)

(73) Assignee: Panasonic Electric Works Power Tools Co., Ltd., Shiga (JP)

( * ) Notice: Subject to any disclaimer, the term of this patent is extended or adjusted under 35 U.S.C. 154(b) by 0 days.

(21) Appl. No.: 12/585,864

(22) Filed: Sep. 28, 2009

(65) Prior Publication Data

US 2010/0078186 A1 Apr. 1, 2010

(30) Foreign Application Priority Data

Sep. 30, 2008 (JP) ..... 2008-255425

(51) Int. Cl.
*B25D 15/02* (2006.01)

(52) U.S. Cl. ..... 173/122; 173/90; 173/104; 173/117

(58) Field of Classification Search ..... 173/122, 173/90, 104, 117
See application file for complete search history.

(56) References Cited

U.S. PATENT DOCUMENTS

| | | | | |
|---|---|---|---|---|
| 2,745,528 | A | 5/1956 | Amtsberg | |
| 2,907,240 | A | 10/1959 | Schwenk et al. | |
| 5,601,149 | A * | 2/1997 | Kawasaki et al. | 173/93.5 |
| 5,673,758 | A * | 10/1997 | Sasaki et al. | 173/178 |
| 6,733,414 | B2 * | 5/2004 | Elger | 475/331 |
| 7,048,075 | B2 * | 5/2006 | Saito et al. | 173/93.5 |
| 7,410,007 | B2 * | 8/2008 | Chung et al. | 173/48 |
| 7,416,031 | B2 * | 8/2008 | Murakami et al. | 173/211 |
| 2006/0237205 | A1 * | 10/2006 | Sia et al. | 173/48 |
| 2008/0035360 | A1 * | 2/2008 | Furuta | 173/104 |
| 2009/0038816 | A1 * | 2/2009 | Johnson et al. | 173/109 |
| 2009/0242222 | A1 * | 10/2009 | Nagasaka et al. | 173/93 |

FOREIGN PATENT DOCUMENTS

| | | |
|---|---|---|
| GB | 852752 | 11/1960 |
| JP | 2006-175553 | 7/2006 |

OTHER PUBLICATIONS

European Search Report dated Feb. 3, 2010.

* cited by examiner

*Primary Examiner* — Brian D Nash
(74) *Attorney, Agent, or Firm* — Bacon & Thomas, PLLC

(57) ABSTRACT

A rotary impact tool includes a drive shaft rotationally driven by a rotational drive power source, a hammer arranged around the drive shaft, a ball engaging with a cam groove formed on the outer circumferential surface of the drive shaft and a cam groove formed on the inner circumferential surface of the hammer, an anvil engageable with the hammer along a rotational direction and a spring for biasing the hammer toward the anvil. The hammer is designed to rotate along a rotational locus decided by the cam groove of the drive shaft and the cam groove of the hammer. The rotational locus of the hammer as seen in a development view describes a curve in which the lead angle of the rotational locus varies continuously with the change in hammer rotation angle.

3 Claims, 2 Drawing Sheets

ROTARY IMPACT TOOL

FIELD OF THE INVENTION

The present invention relates to a rotary impact tool and, more specifically, to a rotary impact tool in which the transfer of rotation between a drive shaft and a hammer is performed by balls engaging with cam grooves formed in the drive shaft and the hammer.

BACKGROUND OF THE INVENTION

Conventionally, there is known a rotary impact tool of the type including a drive shaft rotationally driven by an electric motor or a pneumatic motor and a hammer loosely fitted to the outer circumferential surface of the drive shaft. Cam grooves are formed on the outer circumferential surface of the drive shaft and on the inner circumferential surface of the hammer. Balls engage with the cam grooves of the drive shaft and the hammer so that the rotation of the drive shaft can be transferred to the hammer through the balls. As the hammer makes forward and rotating movement with respect to the drive shaft under the guidance of the cam grooves and the balls, it applies a rotary impact to an anvil provided with an output bit.

One example of conventional rotary impact tools is shown in FIG. 3. This rotary impact tool is disclosed in Japanese Patent Laid-open Application No. 2006-175553, wherein an output shaft 1 of a motor as a rotational power source is connected to a drive shaft 3 through a speed reduction mechanism 2 including a planetary gear mechanism.

A hammer 5 biased forwards by a spring 9 is loosely fitted to the outer circumferential surface of the drive shaft 3. Obliquely-extending V-shaped cam grooves 3*a* are formed on the outer circumferential surface of the drive shaft 3, while axially-extending straight cam grooves 5*a* are formed on the inner circumferential surface of the hammer 5. Balls 4 are arranged to engage with both the cam grooves 3*a* and the cam grooves 5*a*. Each of the cam grooves 3*a* has an obliquely-extending portion used in forward rotation and a reversely-extending portion used in reverse rotation. Rotation of the drive shaft 3 is transferred to the hammer 5 through the balls 4. The hammer 5 is provided with locking claws 6 protruding forwards.

An anvil 8 is rotatably supported on the front end portion of a gear case 7 by a bearing 70. The anvil 8 is provided at its front end with a chuck for holding an output bit and at its rear end with arm portions 8*a* rotationally engaging with the locking claws 6 of the hammer 5. The front end portion of the drive shaft 3 is rotatably supported within a bearing hole portion formed at the rear end of the anvil 8. Reference numeral 18 in FIG. 3 designates a housing.

When the work load is light, rotation of the drive shaft 3 is transferred to the anvil 8 through the hammer 5 by the engagement between the locking claws 6 of the hammer and the arm portions 8*a* of the anvil 8. If the work load becomes greater, the hammer 5 moves backwards against the spring 9 due to the angle of contact surfaces of the locking claws 6 and the arm portions 8*a*. At the time point when the locking claws 6 ride over the arm portions 8*a*, the hammer 5 is moved forwards by the biasing force of the spring 9. Due to the inclination of the cam grooves 3*a*, the hammer 5 rotates faster than the drive shaft 3 and strikes the anvil 8. As the anvil 8 is struck by the hammer 5 having the energy originating from the biasing force of the spring 9 and the rotational speed and inertial moment of the hammer 5, a large magnitude of torque is applied to the anvil 8. The drive shaft 3 continues to rotate while the hammer 5 reciprocates relative to the drive shaft 3 along the cam grooves 3*a*. Thus, the locking claws 6 of the hammer 5 ride over the arm portions 8*a* of the anvil 8. When the locking claws 6 strike the arm portions 8*a* next time, the hammer 5 strikes the anvil 8 in a state that it is rotated about 180° with respect to the anvil 8.

In this regard, the impact force of the hammer 5 against the anvil 8 becomes greater if the rotational velocity of the hammer 5 when striking the anvil 8 is higher. In other words, the rotational velocity of the hammer 5 can be found by the following equation from the kinetic energy conservation law:

spring energy of the spring 9 accumulated by backward movement of the hammer 5=total sum of the energy during rotation of the hammer 5=axial kinetic energy+rotational kinetic energy+spring energy. This can be represented by: $KZmax^2/2=MZv^2/2+JZr^2/2+KZ^2/2$, where K is a spring constant, Zmax is the backward movement distance of the hammer 5, M is the mass of the hammer 5, Zv is the axial velocity of the hammer 5, Zr is the rotational velocity of the hammer 5, Z is the bending deflection of the spring 9 and J is the inertial moment of the hammer 5.

The rotational striking impact applied to the anvil 8 by the hammer 5 is greatly affected by the second term, i.e., the rotational energy term, of the right-hand member in the above equation. Therefore, there is a need to increase the rotational velocity Zr at the striking time.

The rotational velocity Zr is given by the equation: $Zr=Z\cdot\cos\theta$, where $\theta$ is the lead angle of the locus of the hammer 5. In order to increase the rotational velocity Zr, the lead angle $\theta$ of the cam grooves 5*a* is set small.

Conventionally, the rotational locus of the hammer 5 as seen in a development view is set to change linearly, which imposes the following constraints. The cam grooves 3*a* and the cam grooves 5*a* need to be formed at two points on the circumferential surfaces of the hammer 5 and the drive shaft 3. If the lead angle of each of the cam grooves 3*a* and the cam grooves 5*a* is made small within such an extent that the cam grooves 3*a* or the cam grooves 5*a* do not interfere with each other, it is difficult for the hammer 5 to have great enough axial displacement. This means that the energy accumulated in the spring 9 by the backward movement of the hammer 5 becomes small, consequently resulting in reduction in the rotational velocity of the hammer 5.

SUMMARY OF THE INVENTION

In view of the above, the present invention provides a rotary impact tool capable of increasing the striking force thereof to the highest possible degree within the constraints imposed on cam grooves.

In accordance with a embodiment of the invention, there is provided a rotary impact tool including: a drive shaft rotationally driven by a rotational drive power source, the drive shaft having an outer circumferential surface and a cam groove formed on the outer circumferential surface; a hammer arranged around the drive shaft, the hammer having an inner circumferential surface and a cam groove formed on the inner circumferential surface; a ball engaging with the cam groove of the drive shaft and the cam groove of the hammer; an anvil engageable with the hammer along a rotational direction; and a spring for biasing the hammer toward the anvil, wherein the hammer is designed to rotate along a rotational locus decided by the cam groove of the drive shaft and the cam groove of the hammer, and wherein the rotational locus of the hammer as seen in a development view describes a curve in which the lead angle of the rotational locus varies continuously with the change in hammer rotation angle.

In the rotary impact tool, one of the cam grooves of the drive shaft and the hammer may be formed to follow a straight line when seen in a development view and the other may be formed to follow a curved line when seen in a development view, so that the rotational locus of the hammer describes the curve in which the lead angle of the rotational locus varies continuously with the change in hammer rotation angle. In the rotary impact tool, both the cam grooves of the drive shaft and the hammer may be formed to follow curved lines when seen in a development view, so that the rotational locus of the hammer describes the curve in which the lead angle of the rotational locus varies continuously with the change in hammer rotation angle.

With such configuration, the rotational velocity of the hammer at the striking time can be increased by optimizing the rotational locus of the hammer. This makes it possible to increase the impact applied to the anvil and to enhance the performance of the rotary impact tool, without having to increase the mass of the hammer or the revolution number of a motor. If the enhanced performance is diverted to reducing the weight of the hammer, it becomes possible to make the rotary impact tool easy-to-handle and lightweight.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Figure 3:
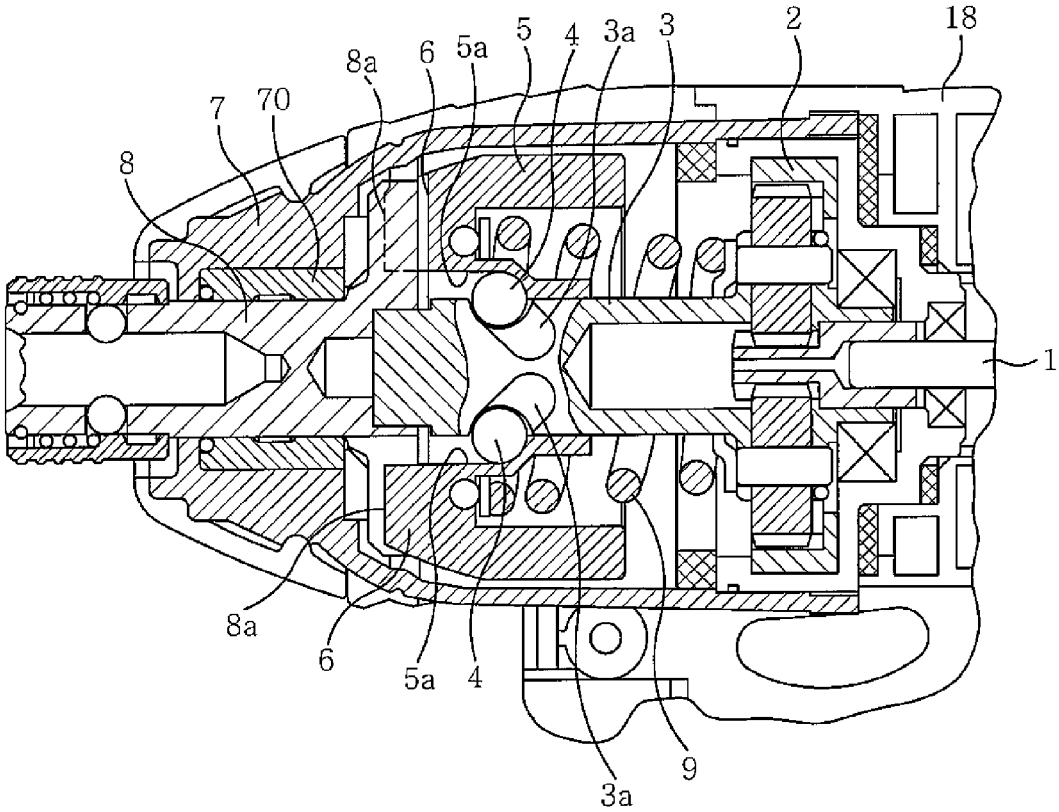
FIG. 3 (PRIOR ART)
FIG. 3 is a section view showing conventional mechanical parts of the rotary impact tool.

Hereinafter, a rotary impact tool in accordance with an embodiment of the present invention will be described with reference to the accompanying drawings. In the structural aspect, the rotary impact tool of the present invention is substantially the same as the conventional one set forth earlier. Referring to FIG. 3, the rotary impact tool includes a drive shaft 3 and a hammer biased forwards by a spring 9. Substantially V-shaped cam grooves 3*a* are formed on the outer circumferential surface of the drive shaft 3 and cam grooves 5*a* are formed on the inner circumferential surface of the hammer 5. Balls 4 engage with the cam grooves 3*a* and 5*a* to operatively interconnect the drive shaft 3 and the hammer 5.

Figure 1:
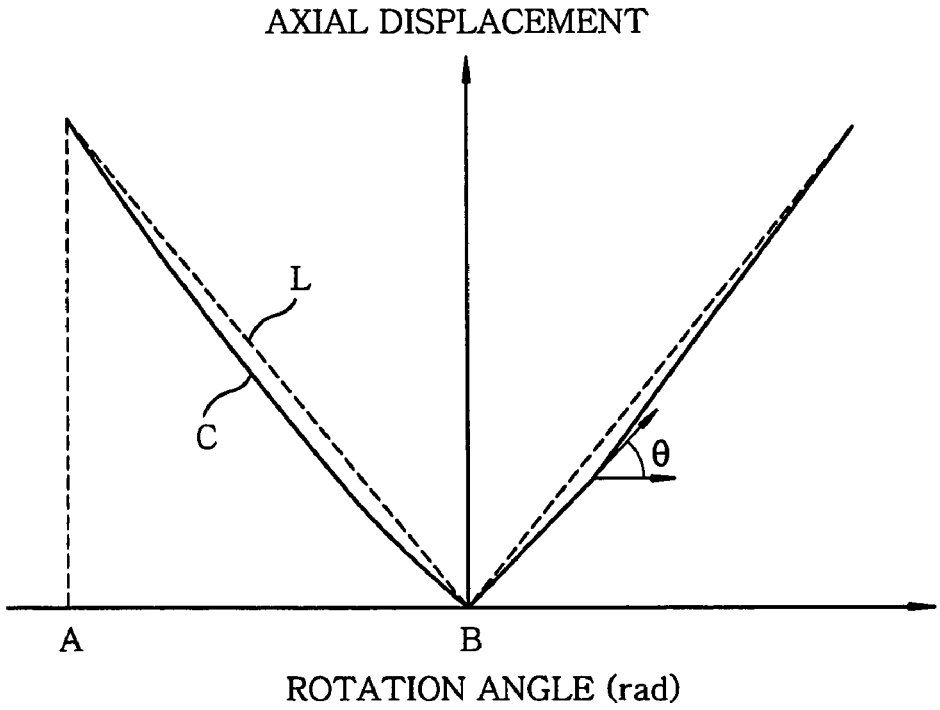
FIG. 1 is a view for explaining the shape of cam grooves of a rotary impact tool in accordance with one embodiment of the present invention.

The center locus of each of the cam grooves 3*a* of the drive shaft 3 is not a straight line L but a cycloid curve C as shown in FIG. 1. Each of the cam grooves 5*a* is formed to follow a straight line. This ensures that, when the hammer 5 strikes an anvil 8 and applies a striking impact thereto, the rotational locus of the hammer 5 as seen in a development view describes a cycloid curve in which the lead angle of the rotational locus varies continuously with the change in hammer rotation angle.

Figure 2:
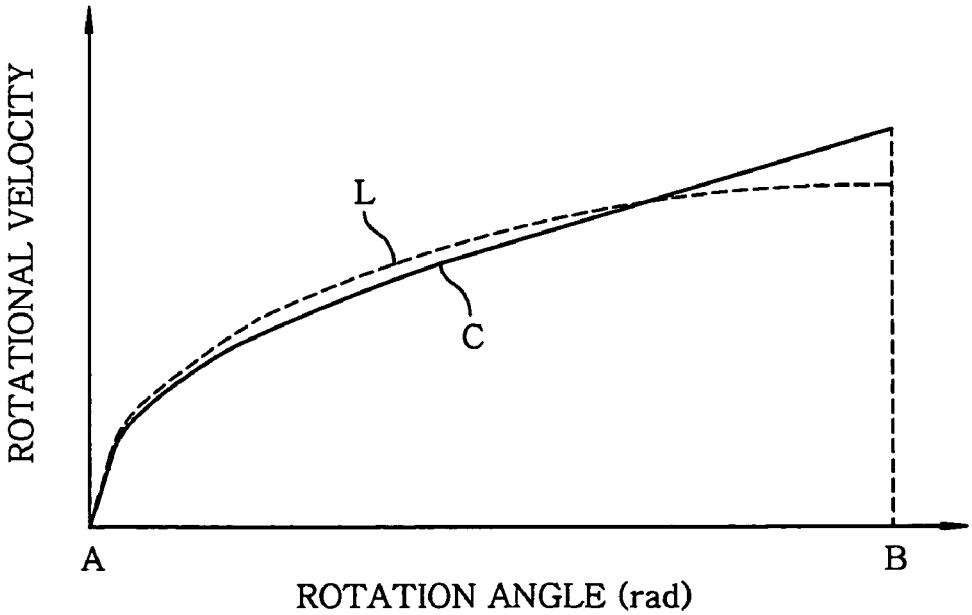
FIG. 2 is a view for explaining the rotational velocity of a hammer employed in the rotary impact tool.

In FIGS. 1 and 2, reference character "A" designates a time point at which the hammer 5 is in a rearmost position and reference character "B" designates a time point at which the hammer 5 strikes the anvil 8. The rotational locus of the hammer 5 as seen in a development view describes a cycloid curve C in which the lead angle 8 becomes small at the striking time point. Therefore, as compared to a case that the rotational locus of the hammer 5 as seen in a development view describes a straight line L, the rotational velocity of the hammer 5 at the time when the hammer 5 starts forward movement is low but the rotational velocity of the hammer 5 at the time when the hammer 5 strikes the anvil 8 becomes high as can be seen in FIG. 2, eventually increasing the striking impact applied to the anvil 8.

The lead angle θ is great at the time point when the hammer 5 is in the rearmost position. This prevents the possibility that one of the cam grooves 3*a* may interfere with the other. Although each of the cam grooves 3*a* describes a cycloid curve C in the illustrated embodiment, it is equally possible to reduce the lead angle (or inclination angle) θ of the rotational locus at the striking time by employing a portion of a high-order curve, a parabola or the like.

The same results can be obtained by forming the cam grooves 3*a* into a linear shape and forming the cam grooves 5*a* into a curved shape. In case where the rotary impact tool is designed to apply a striking force during the forward and reverse rotation as in the illustrated embodiment, it is preferred that the width of the cam grooves 5*a* varies gently depending on the axial position thereof. It may also be possible to form both the cam grooves 3*a* and the cam grooves 5*a* into a gently-changing curved shape. By doing so, the rotational locus of the hammer 5 as seen in a development view can be set so that the lead angle θ can undergo a change and can become gentle at the striking time.

While the invention has been shown and described with respect to the embodiments, it will be understood by those skilled in the art that various changes and modification may be made without departing from the scope of the invention as defined in the following claims.

What is claimed is:

1. A rotary impact tool comprising:

a drive shaft rotationally driven by a rotational drive power source, the drive shaft having an outer circumferential surface and a cam groove formed on the outer circumferential surface;

a hammer arranged around the drive shaft, the hammer having an inner circumferential surface and a cam groove formed on the inner circumferential surface;

a ball engaging with the cam groove of the drive shaft and the cam groove of the hammer;

an anvil engageable with the hammer along a rotational direction; and a spring for biasing the hammer toward the anvil, wherein the cam groove of the drive shaft and the cam groove of the hammer cause the hammer to rotate about an axis extending along a longitudinal direction of the drive shaft such that a fixed point on the hammer generates a locus of points that form a curve when plotted in a development view, and a lead angle of the rotational locus varies continuously as the hammer rotates.

2. The rotary impact tool of claim 1, wherein one of the cam grooves of the drive shaft and the hammer is formed to follow a straight line when seen in a development view and the other is formed to follow a curved line when seen in a development view, so that the rotational locus of the hammer describes the curve in which the lead angle of the rotational locus varies continuously as the hammer rotates.

3. The rotary impact tool of claim 1, wherein both the cam grooves of the drive shaft and the hammer are formed to follow curved lines when seen in a development view, so that the rotational locus of the hammer describes the curve in which the lead angle of the rotational locus varies continuously as the hammer rotates.

* * * * *